US006473972B1

(12) United States Patent
Guerin

(10) Patent No.: US 6,473,972 B1
(45) Date of Patent: Nov. 5, 2002

(54) CUTTING APPARATUS

(76) Inventor: Phillip Guerin, 110 Ferry St., Lawrence, MA (US) 01841

( * ) Notice: Subject to any disclaimer, the term of this patent is extended or adjusted under 35 U.S.C. 154(b) by 0 days.

(21) Appl. No.: 09/565,056

(22) Filed: May 3, 2000

(51) Int. Cl.[7] ..... B26B 17/00
(52) U.S. Cl. ..... 30/181; 30/186
(58) Field of Search ..... 30/181, 204, 261, 30/253, 254, 186, 244; 83/600, 604, 644, 950

(56) References Cited

U.S. PATENT DOCUMENTS

| | | | | |
|---|---|---|---|---|
| 58,326 A | | 9/1866 | Waters | |
| 59,168 A | | 10/1866 | Bender | |
| 593,337 A | | 11/1897 | Smith | |
| 1,572,546 A | * | 2/1926 | McKenney | 30/261 X |
| 1,640,168 A | | 8/1927 | Williams | |
| 2,753,630 A | | 7/1956 | Shoemaker | 30/249 |
| 4,096,630 A | | 6/1978 | Honick | 30/258 |
| D329,579 S | | 9/1992 | Guerin | D8/52 |

* cited by examiner

*Primary Examiner*—Douglas D. Watts
(74) *Attorney, Agent, or Firm*—David M. Driscoll

(57) ABSTRACT

A cutting apparatus that includes a handle, a first arm and a second arm. A hinge pin pivotally supporting the first and second arms about a pivot point adjacent facing ends of the arms. A cutter blade is supported from at least one of the first and second arms. A pivot mechanism incouples a handle at the outer ends of the arms and includes a spring for biasing the arms to a position wherein the cutter blade is closed. The pivot mechanism interacts with the arms to bias the arms to a position wherein the cutter blade is closed while enabling the pivoting of the arms to open the cutter blade to receive a wire or the like for cutting.

25 Claims, 4 Drawing Sheets

CUTTING APPARATUS

BACKGROUND OF THE INVENTION

1. Field of the Invention

The present invention relates in general to a cutting apparatus. More particularly, the present invention relates to a wire or bolt cutter. Even more particularly, the present invention relates to a mechanical cutting device that is preferably mounted on an extendable pole for cutting wires or bolts that are disposed overhead.

2. Background Discussion

Many buildings have suspended ceilings and during renovations these ceilings are sometimes removed. When a worker is cutting down a ceiling with a ladder he must climb up and down the ladder and move it to every location where a wire is hung. If the worker is using scaffolds, the floor has to be cleaned constantly so it can be repositioned. Both of these methods are time consuming.

OBJECTS OF THE INVENTION

Accordingly, it is an object of the invention to provide a wire cutter that is actuable by a user on the floor to cut a wire or bolt which usually can not be reached without a ladder or scaffold.

Another object of the present invention is to provide a wire cutter that has a guiding means to help position the wire between the cutters.

Still another object of the present invention is to provide a wire cutter that is actuable by a user to first push the tool onto the wire and secondly to pull the tool to cut the wire.

SUMMARY OF THE INVENTION

To accomplish the foregoing and other objects, features and advantages of the invention, there is provided a cutting apparatus that comprises a handle, a first arm and a second arm. A hinge member is provided for pivotally supporting the first and second arms about a pivot point that is adjacent facing ends of these arms. A cutter blade is supported from at least one of the first and second arms. A pivot mechanism intercouples the handle and the outer ends of the first and second arms and includes a spring for biasing the arms to a position wherein the cutter blade is closed. The pivot mechanism interacts with the arms to bias the arms to a position where the cutter blade is closed while enabling a pivoting of the arms to open the cutter blade to receive a wire or the like for cutting.

More particularly, the cutter blade may be comprised of a pair of cutter blades one supported from each respective first and second arm. In one embodiment in accordance with the present invention the pivot mechanism may include a hinged handle extension and a bracket. In accordance with another embodiment of the present invention the pivot mechanism may comprise a pair of flexture springs. In accordance with a further feature of the present invention, the handle may be secured to an extendable pole. In accordance with still a further feature of the present invention, one or both of the arms may be provided with a guide means for guiding against the item to be cut.

The cutting apparatus of the present invention is preferably useable for removing suspended ceilings and thus cutting wires or the like associated with suspended ceilings. As indicated previously, the cutting apparatus may be used with an extension pole depending upon the height of the ceiling involved. However, it is also to be understood that the cutting apparatus of the present invention may be used on other types of cutting applications.

BRIEF DESCRIPTION OF THE DRAWINGS

Numerous other objects, features and advantages of the invention should now become apparent upon the reading of the following detailed description taken in conjunction with the accompanying drawings in which.

DETAILED DESCRIPTION

Figure 1:
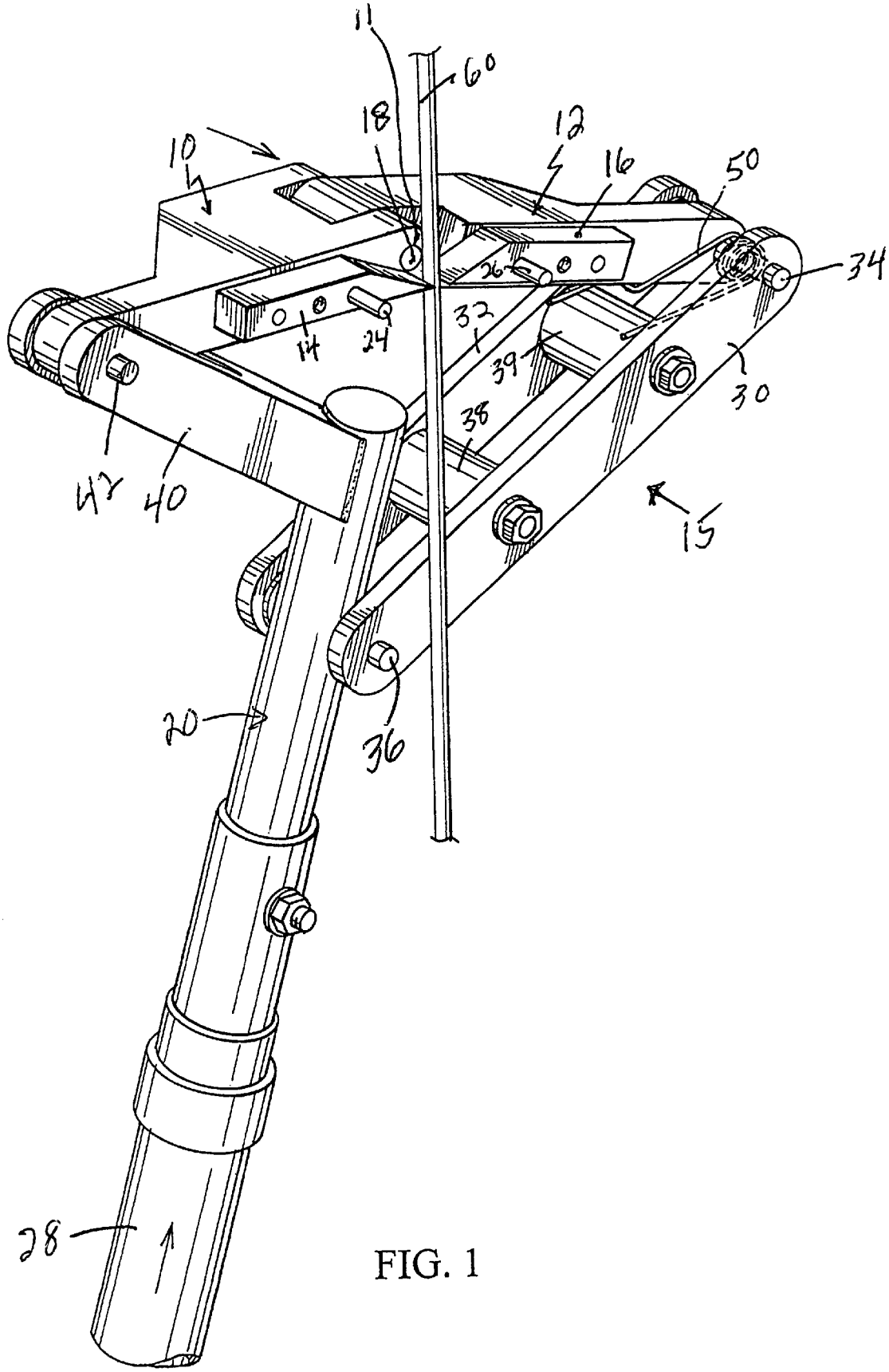
FIG. 1 is a perspective view of the cutting apparatus of the present invention illustrating a wire being grasped by the cutter blades.

Reference is now made to the drawings herein. A first embodiment of the invention is illustrated in FIGS. 1–4. A second embodiment of the invention is illustrated in FIG. 5.

With respect to the first embodiment illustrated in FIGS. 1–4, the cutting apparatus comprises handle 20, an arm 10 and an arm 12. Interconnecting the arms 10 and 12 with the handle 20 is a pivot mechanism 15. The pivot mechanism 15 may be considered as comprising, inter alia, brackets 30 and 32, on one side, and extension piece 40 on the other side.

The arms 10 and 12 are supported at facing ends by means of pivot pin 18. The outer end of arm 10 is supported from extension piece 40 by means of pivot pin 42. Similarly, the outer end of arm 12 is supported from brackets 30 and 32 by means of pivot pin 34. It is noted that the spring 50 is supported about the pivot pin 34 and extends under the arm 12. It is spring 50 that biases the arms 10 and 12 to an upward position such as that illustrated in FIG. 2 herein.

The pivot mechanism 15, in addition to comprising brackets 30 and 32 as well as extension piece 40, includes, along with the pivot pin 34, a pivot pin 36 that attaches the brackets to the handle 20. There also are included spacers 38 and 39 appropriately supported, as illustrated, between the brackets 30 and 32.

Figure 2:
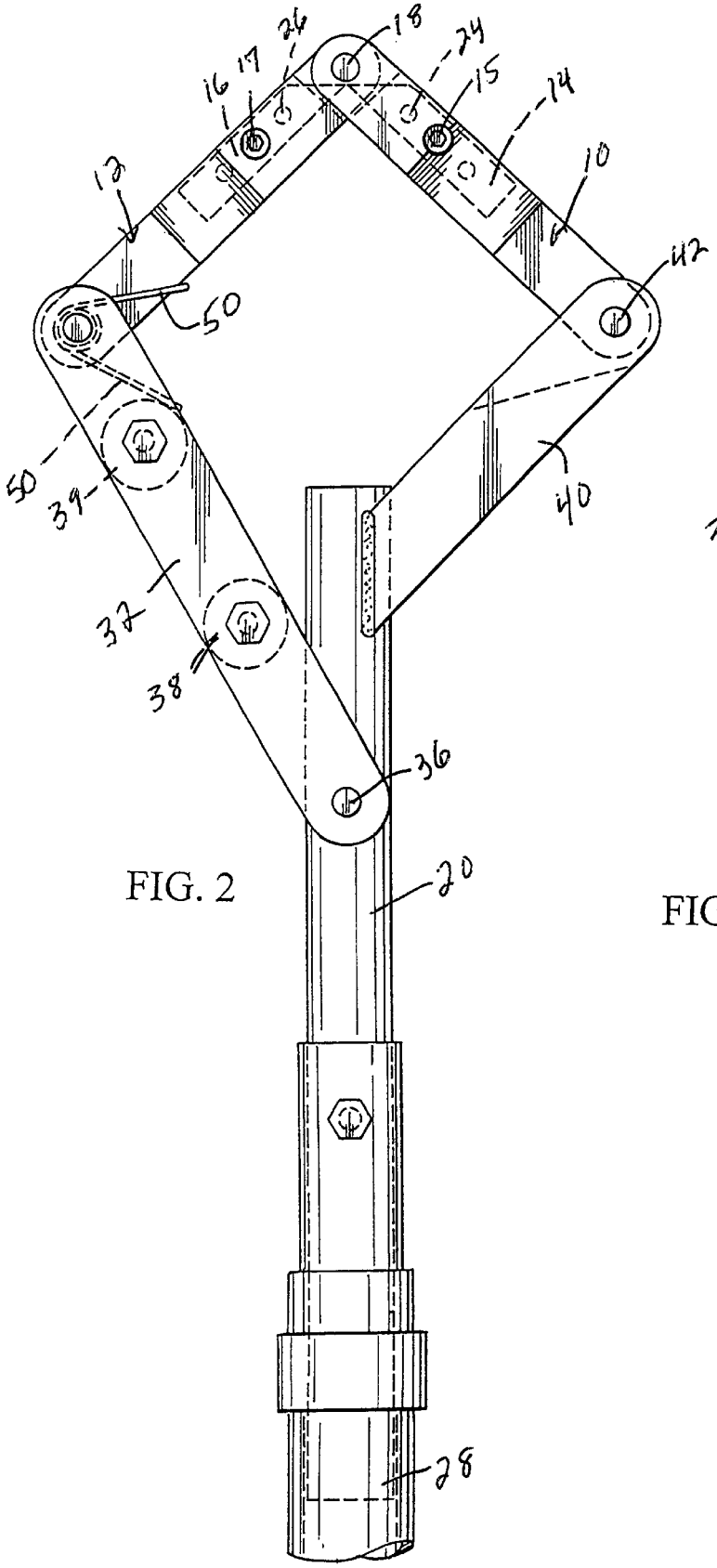
FIG. 2 is a rear view of the cutting apparatus of the present invention.
Figure 3:
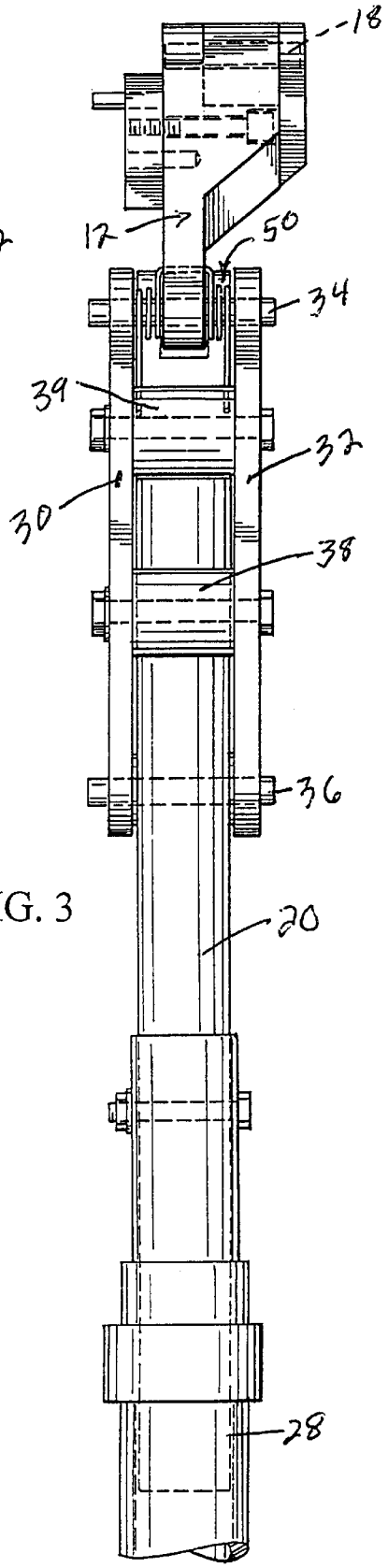
FIG. 3 is a side view of the cutting apparatus illustrated in FIGS. 1 and 2 taken along line 3—3 of FIG. 2.

On the arms 10 and 12 are respective cutting blades 14 and 16. As illustrated in FIG. 2, these cutting blades may be attached to the arms by respective Allen screws 15 and 17. Also associated with the cutting blades are respective guide posts 24 and 26. These guide posts are for guiding the wire 60 to a position between the blades of the cutting members 14 and 16. Also functioning as a guide is the portion 11 of arm 10 that may also tend to engage the wire 60.

The apparatus of the present invention also preferably includes a pole extension 28. This may be a telescoping type extension or separate extensions of different length may be employed.

For a typical suspended ceiling that is to be removed, it is one purpose of the cutting apparatus of the present invention to cut the wires that suspend the ceiling without requiring the use of ladders or scaffolds. For this purpose, an extension is usually used with the handle 20. The length of the extension will depend upon the ceiling height and the particular room.

Reference is now made to FIG. 5 for an alternate embodiment of the present invention. In FIG. 5, similar components are labeled the same as in the first embodiment of FIGS. 1–4. Thus, in this embodiment there are provided arms 10 and 12 carrying respective cutting blades 14 and 16. However, in this embodiment the pivot mechanism is basically comprised of a pair of flex springs 70 and 72. The base end of each of these flex springs is secured by bolts 74 and associated nuts to the top of the handle 20, as illustrated in FIG. 5. The top of each of the flex springs 70 and 72 is secured to respective arms 10 and 12 also by means of bolts 76, as illustrated in FIG. 5.

FIG. 5 shows, in solid outline, the cutting apparatus with the blades in their closed position. It is noted that the very tips of both blades are in contact with each other. FIG. 5 also shows, in phantom, the position of the flex springs and the associated arms when the arms are deflected downwardly to grasp a wire (not shown in FIG. 5). The operation of the apparatus in FIG. 5 is substantially the same as the operation of the first embodiment depicted in FIGS. 1–4.

Figures 4, 4A, 4B:
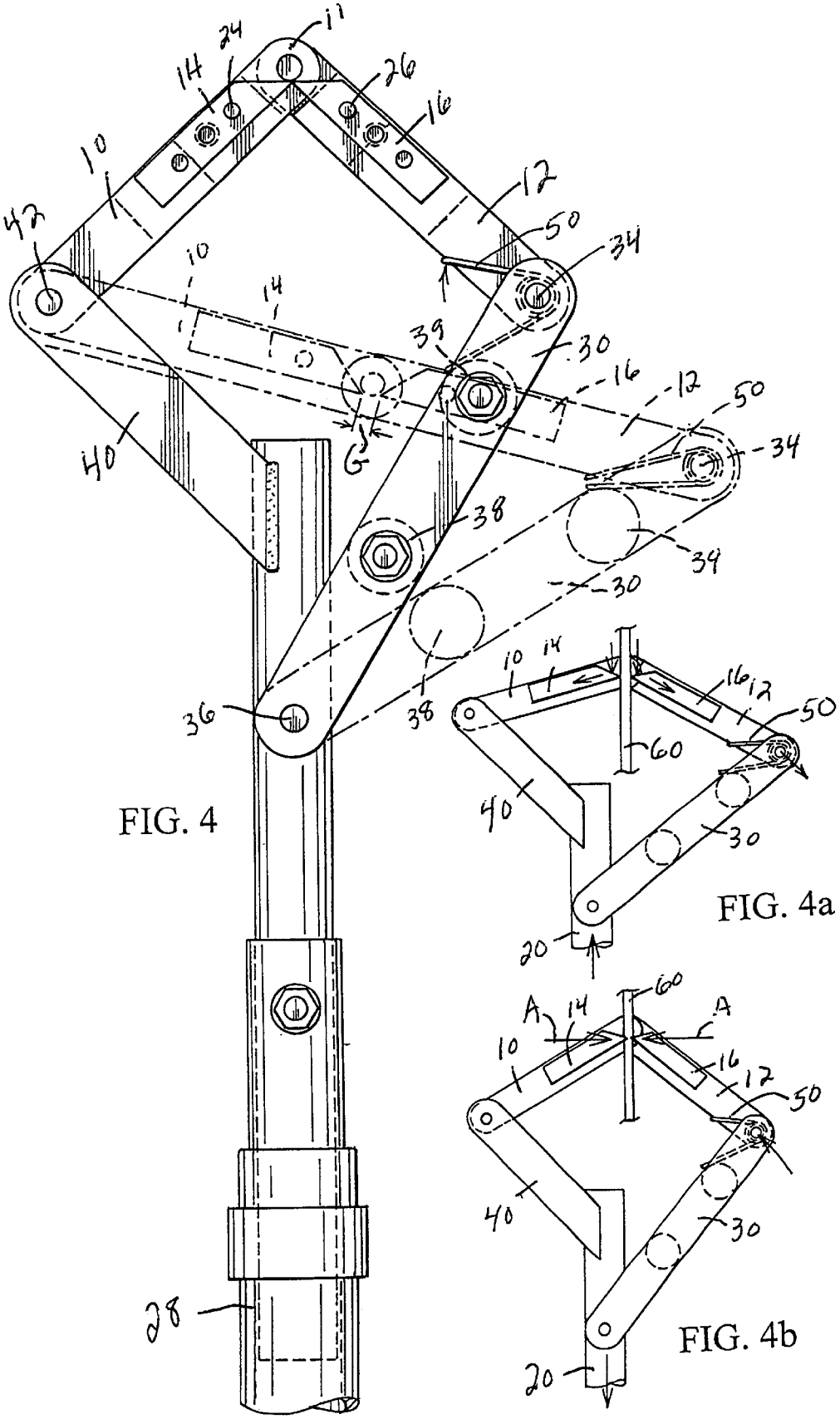
FIG. 4 is a front view of the cutting apparatus of FIGS. 1–3 illustrating the apparatus in its normal biased closed position in solid outline and also illustrating the apparatus in its open position in phantom.
FIG. 4A is a schematic illustration relating to FIG. 4 with the apparatus just grasping the wire.
FIG. 4B is a schematic illustration of the apparatus of FIG. 4 with the wire being cut.
Figure 5:
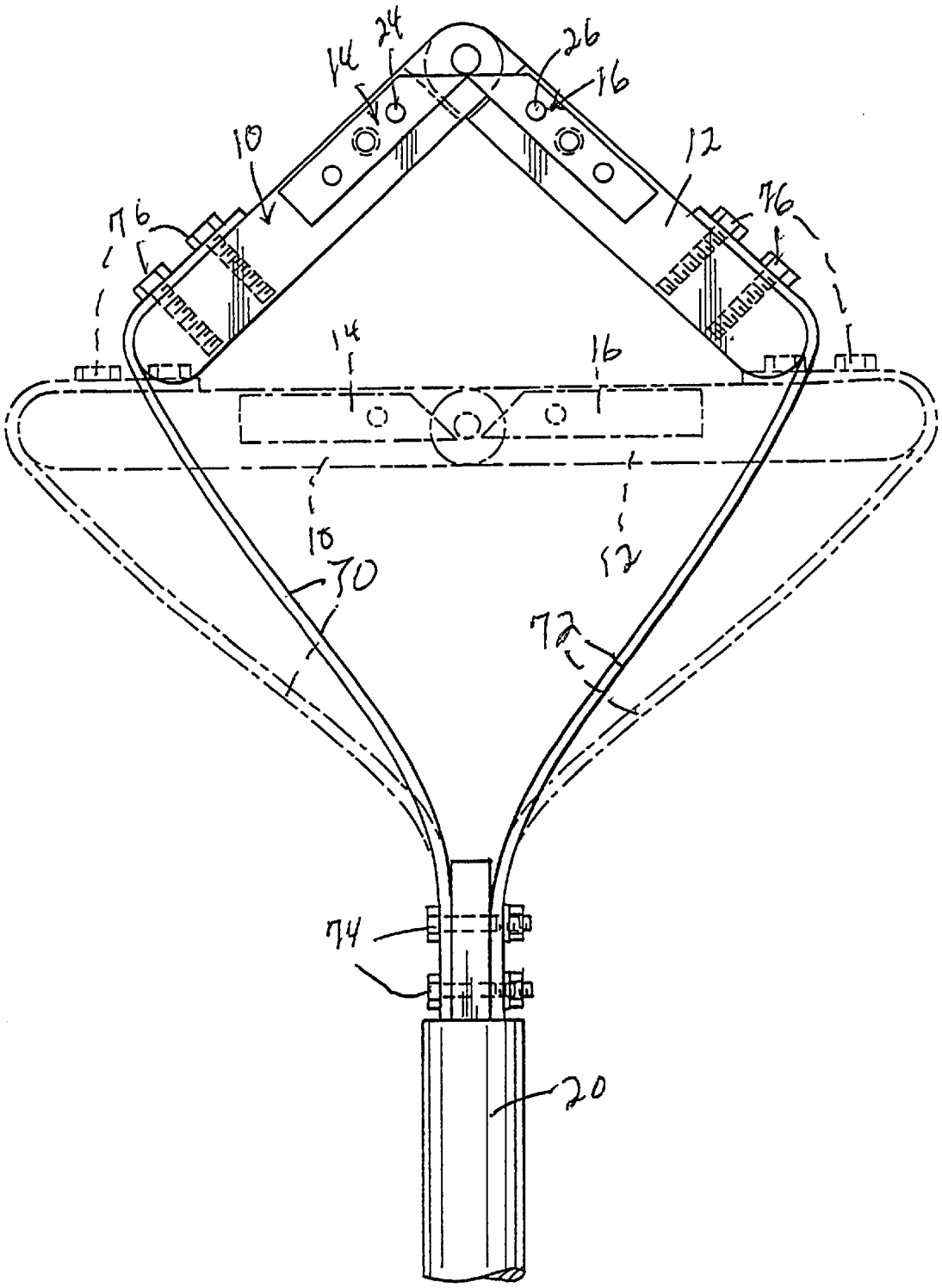
FIG. 5 is a view of a second embodiment of the present invention.

With regard to the operation of the cutting apparatus of the present invention, and with reference to FIGS. 4A and 4B, and starting from an initial position as shown in solid outline in FIG. 4, the apparatus engages the wire 60 between the pins 24 and 26. The pins 24 and 26 form a guide so that the wire extends therebetween. In FIG. 4A it is noted that the handle 20 is basically moved in an upward direction against the wire. This causes the arms 10 and 12 to deflect downwardly as illustrated in FIG. 4A against the bias of spring 50. The area 11 of the arm 10 also may provide a contact point for the wire 60.

It is noted, such as in FIGS. 4 and 4A, that as the arms 10 and 12 pivot downwardly so that they move towards a straight in-line position, the cutting blades 14 and 16 separate. This separation, when the arms are in-line, is illustrated in FIG. 4 by the dimension G. This would be a typical gap that would be provided so as to receive any wire, bolt or the like for the purpose of cutting. Once this gap becomes larger than the diameter of the wire, then the wire simply slips in between the two blades, such as in the position shown in FIG. 4A.

The cutting is accomplished by means of the motion illustrated in FIG. 4B. It is noted in FIG. 4B that the handle 20 is moved downwardly. This causes a force in the direction of arrows A, imposed against the wire 60 to cut the wire between the two cutting blades 14 and 16. Once the wire is cut and disengages from the cutting apparatus, the cutting apparatus then is biased by the spring 50 back to the position such as shown in FIGS. 2 and 4.

With regard to the operation of the embodiment of FIG. 5, this operates in substantially the same way as the first embodiment of FIGS. 1–4. When a wire is engaged between the pins 24 and 26, the arms deflect toward a straight in-line position, such as illustrated in phantom outline in FIG. 5. The wire is lodged between the cutting blades 14 and 16. A downward movement or jerking of the handle 20 causes the cutting blades to cut the wire as previously described.

FIG. 4 illustrates the different positions of the movable arms 10 and 12 and movable brackets 30 and 32. More particularly in FIG. 4 the cutters 14 and 16 are shown in their solid position closed so that the blades of the cutters are together. On the other hand, the cutters 14 and 16 are shown in their phantom position to represent the position of the cutters when they are pushed against a wire also identified herein as the open position. It is noted that spring 50 is being compressed when cutting blades 14 and 16 are moved from the closed position to the open position when pushed against a wire. Pressure applied to movable arm 12 by spring 50 binds the cutting blades 14 and 16 onto the wire when it falls between the cutters. However, the cut is finished by pulling down pole 28 and thereby closing the blades onto the wire to be cut.

Having now described a limited number of embodiments of the present invention, it should be apparent to those skilled in the art that numerous modifications can be made thereto, all falling within the scope of the present invention. For example, although two separate cutting blades 14 and 16 are shown, a single sharpened blade member could be employed against another abutment to cause cutting of the wire. Also, the apparatus of the present invention can be used for other cutting applications, other than cutting wires of suspended ceilings.

What is claimed is:

1. A cutting apparatus comprising:

a handle;

a first arm;

a second arm;

a hinge member for pivotally supporting said first and second arms about a pivot point adjacent facing ends of said arms;

a cutting mechanism supported from at least one of said first and second arms;

and a pivot mechanism intercoupling said handle and outer ends of said first and second arms and including a spring for biasing said arms to a position wherein said cutting mechanism is closed said pivot mechanism interacting with said arms to bias said arms to a position wherein the cutting mechanism is closed while enabling a pivoting of the arms to open the cutting mechanism to receive a member for cutting;

and guide pieces for holding the wire therebetween.

2. A cutting apparatus according to claim 1, wherein said cutting mechanism includes a pair of cutter blades and said guide pieces comprise guide rods extending respectively from said cutter blades.

3. A cutting apparatus comprising:

a handle;

a first arm;

a second arm;

a hinge member pivotally supporting said first and second arms about a pivot point adjacent facing ends of said arms;

a cutting mechanism supported from at least one of said first and second arms;

and a pivot mechanism intercoupling said handle and outer ends of said first and second arms and including a spring for biasing said arms to a position wherein said cutting mechanism is closed;

said pivot mechanism interacting with said arms to bias said arms to a position wherein the cutting mechanism is closed while enabling a pivoting of the arms to open the cutting mechanism to receive member for cutting;

wherein said pivot mechanism comprises a pair of brackets on one side and an extension piece on the other side.

4. A cutting apparatus according to claim 3, wherein said extension piece is fixed to said handle at one end and pivoted at the other.

5. A cutting apparatus according to claim 4, including a further pivot pin associated with said brackets for supporting said spring.

6. A cutting apparatus comprising;

a handle; a first arm; a second arm; a hinge pin; means for pivotally supporting said first and second arms about said hinge pin; a cutter means supported from at least one of said first and second arms; and a pivot means intercoupling said handle and the outer ends of said first and second arms; and including a spring means for biasing said arms to a position wherein said cutter means is closed; said pivot mechanism is interacting with said arms to bias said arms to a position wherein the cutter means is closed while enabling a pivoting of the arms to open the cutter means to receive member for cutting, and a guide means, one associated with each of said first and second arms.

7. A cutting apparatus comprising:

a handle;

a first arm;

a second arm;

a pivot for supporting said first and second arms about a pivot axis at inner ends of said arms;

a cutting mechanism supported from at least one of said first and second arms and having open and closed positions;

said cutting mechanism including at least one cutting edge extending substantially in the same direction as said pivot axis;

and a pivot mechanism intercoupling said handle and outer ends of said first and second arms;

said pivot mechanism interacting with said arms to hold said cutting mechanism in its closed position, and enabling a manual pivoting of the arms to move the cutting mechanism to its open position to receive member for cutting.

8. A cutting apparatus according to claim 7 wherein said cutting mechanism comprises a pair of cutting blades supported respectively, from said first and second arms.

9. A cutting apparatus according to claim 8 further comprising guide pieces respectively supported from said cutter blade for holding the wire therebetween.

10. A cutting apparatus according to claim 7 wherein said pivot mechanism comprises a pair of brackets on one side and an extension piece on the other side.

11. A cutting apparatus according to claim 10 wherein said extension piece is fixed to said handle at one end and pivoted at the other.

12. A cutting apparatus according to claim 7 including a pair of pivot pins intercoupling respective outer ends of said arms and said pivot mechanism to enable relative rotation between said arms and pivot mechanism.

13. A cutting apparatus according to claim 7 wherein said pivot mechanism comprises a pair of flexure springs associated respectively with said first arm and said second arm.

14. A cutting apparatus according to claim 7 wherein said handle is moved in a direction away from said arms and orthogonal to said pivot for cutting purposes.

15. A cutting apparatus according to claim 7 wherein said cutting mechanism comprises a pair of cutting blades and said pivot is disposed over said cutting blades.

16. A cutting apparatus comprising; a handle, a first arm, a second arm, a hinge pin for pivotally supporting said first and second arms about said hinge pin, a cutting mechanism supported from at least one of said first and second arms and including open and closed positions, and a pivot mechanism intercoupling said handle and the outer ends of said first and second arms, said apparatus engageable with member for pivoting said arms to open said cutting mechanism and receive said wire or the like, said handle being moveable in a direction away from said arms to close said cutting mechanism to cut said member.

17. A cutting apparatus according to claim 16 wherein said pivot mechanism includes at least first and second pivot members at least one of which is supported from said handle, and both said first and second pivot members being pivotally coupled to outer ends of respective first and second arms.

18. A cutting apparatus according to claim 16 wherein said pivot mechanism comprises a pair of flexure springs associated respectively with said first arm and said second arm.

19. A cutting apparatus according to claim 16 including a pair of pivot pins intercoupling respective outer ends of said arms and said pivot mechanism to enable relative rotation between said arms and pivot mechanism.

20. A cutting apparatus according to claim 16 wherein said cutting mechanism comprises a pair of cutting blades and said pivot is disposed over said cutting blades.

21. A cutting apparatus according to claim 16 wherein said hinge pin extends along a hinge axis and said cutting mechanism includes at least one cutting edge extending substantially in the same direction as said hinge axis.

22. A cutting apparatus according to claim 16 wherein said handle has a longitudinal axis and said cutting mechanism includes at least one cutting blade edge that extends in a direction substantially orthogonal to the handle longitudinal axis.

23. A cutting apparatus comprising;

an elongated handle having a longitudinal axis, a multi-link mechanism having multiple pivot axes with at least one axis coupled to said handle, and said multi-link mechanism including arms intercoupled at another axis, and a cutting mechanism supported from at least one of said arms, said cutting mechanism including at least one cutting blade edge that extends in a direction substantially orthogonal to the handle longitudinal axis;

wherein said apparatus is engageable with a member for pivoting said arms to open said cutting mechanism and receive said wire member, said handle being moveable in a direction away from said arms to close said cutting mechanism to cut said member;

wherein said cutting blade edge is disposed between said another axis and said handle.

24. A cutting apparatus according to claim 23 wherein said multi-link mechanism includes at least first and second pivot members at least one of which is supported from said handle, and both said first and second pivot members are pivotally coupled to outer ends of said arms.

25. A cutting apparatus according to claim 23 wherein said multi-link mechanism further includes a pair of spring members associated, respectively, with said arms and each coupled to said handle.

* * * * *